US011317685B2

(12) United States Patent
Tanaka

(10) Patent No.: US 11,317,685 B2
(45) Date of Patent: May 3, 2022

(54) DEVICE

(71) Applicant: Yoshiko Tanaka, Yokohama (JP)

(72) Inventor: Yoshiko Tanaka, Yokohama (JP)

( * ) Notice: Subject to any disclaimer, the term of this patent is extended or adjusted under 35 U.S.C. 154(b) by 376 days.

(21) Appl. No.: 15/403,495

(22) Filed: Jan. 11, 2017

(65) Prior Publication Data

US 2017/0202320 A1 Jul. 20, 2017

(30) Foreign Application Priority Data

Jan. 14, 2016 (JP) ..... JP2016-005300

(51) Int. Cl.

| | |
|---|---|
| ***A44C 17/00*** | (2006.01) |
| ***A44C 5/00*** | (2006.01) |
| ***A44C 9/00*** | (2006.01) |
| ***A44C 15/00*** | (2006.01) |
| ***A44C 25/00*** | (2006.01) |

(52) U.S. Cl.

CPC ..... *A44C 17/007* (2013.01); *A44C 5/00* (2013.01); *A44C 9/00* (2013.01); *A44C 15/005* (2013.01); *A44C 15/0085* (2013.01); *A44C 25/001* (2013.01)

(58) Field of Classification Search

CPC ..... A44C 17/00; A44C 17/007; A44C 25/00; A44C 25/001

USPC ..... D11/61, 116

See application file for complete search history.

(56) References Cited

U.S. PATENT DOCUMENTS 5,401,561 A * 3/1995 Fisun ..... A44C 19/00 219/121.6
5,970,744 A * 10/1999 Greeff ..... A44C 17/001 63/32
6,508,081 B1 * 1/2003 Simpson ..... A44C 7/002 63/12

(Continued)

FOREIGN PATENT DOCUMENTS

CN 201550719 U 8/2010
CN 202085858 U 12/2011

(Continued)

OTHER PUBLICATIONS

"Understanding Diamond Fluorescence—GIA 4Cs", Gemological Institute of America, https://4cs.gia.edu/en-us/blog/understanding-diamond-fluorescence/ (Year: 2013).*

(Continued)

*Primary Examiner* — Emily M Morgan
(74) *Attorney, Agent, or Firm* — Carrier Blackman & Associates, P.C.; William D. Blackman; Joseph P. Carrier

(57) ABSTRACT

An ornamental device includes: diamonds disposed on a single support element in a specific physical arrangement, all the diamonds in the specific physical arrangement having a blue fluorescent equal to or stronger than strong blue, wherein all the diamonds in the specific physical arrangement shining clear under a visible light, and shining blue under ultraviolet radiation keeping the specific physical arrangement distinguished from a group of diamonds in the specific physical arrangement, the group of diamonds comprising a mixture of a diamond or diamonds having a blue fluorescence equal to or stronger than strong blue and a diamonds or diamonds not having a blue fluorescent equal to or stronger than strong blue.

4 Claims, 4 Drawing Sheets

(56) References Cited

U.S. PATENT DOCUMENTS

| | | | | |
|---|---|---|---|---|
| 6,553,786 | B1 * | 4/2003 | Kwiat | A44C 15/0015 63/26 |
| D746,719 | S * | 1/2016 | Weems | D11/40 |
| 2005/0150252 | A1 * | 7/2005 | Renter | A44C 7/003 63/12 |
| 2006/0086143 | A1 * | 4/2006 | Biro | A44C 17/001 63/32 |
| 2009/0100870 | A1 * | 4/2009 | Lai | A44C 17/005 63/28 |
| 2009/0290141 | A1 * | 11/2009 | Friedman | A44C 17/00 356/30 |
| 2014/0298860 | A1 * | 10/2014 | Westenburg | A44C 7/002 63/12 |
| 2015/0007609 | A1 * | 1/2015 | Zelikman | A44C 17/007 63/3 |
| 2015/0013381 | A1 * | 1/2015 | Duffy | A44C 7/003 63/12 |

FOREIGN PATENT DOCUMENTS

| | | | |
|---|---|---|---|
| FR | 2893824 | A1 | 6/2007 |
| JP | 3280594 | B2 | 5/2002 |
| WO | 2010/052702 | A1 | 5/2010 |

OTHER PUBLICATIONS

Official Communication issued in the corresponding Chinese Patent Application No. 201710020919.0 dated Mar. 20, 2019.

Examination Report dated Jun. 7, 2021 issued in the corresponding Australian Patent Application No. 2018259984.

Ellissi Jewellery, Fluorescence, published Feb. 20, 2017 as per Wayback Machine, [retrieved from internet on Jun. 7, 2021] <URL: https://web.archive.org/web/20170220125010/https://www.ellissi.com.au/fluorescence/>.

* cited by examiner

DEVICE

CROSS-REFERENCE TO RELATED APPLICATION

This application is based upon and claims the benefit of priority from the prior Japanese Patent Application No. 2016-005300 filed on Jan. 14, 2016, the entire contents of which are incorporated herein by reference.

FIELD

The embodiment discussed herein is related to ornamental device comprising diamonds.

BACKGROUND

An ornamental device such as a diamond ring, a diamond necklace, or the like is well known. Diamonds shine white and clear under a visible light such as the natural light based on irradiance, dispersion and glance. People usually like such a clear brightness, so that diamonds are evaluated by observing the 4C's, namely, Carat Weight, Cut, Color, and Clarity. A colorless diamond having the excellent cut and less inclusion or blemish demands a higher price.

Some natural diamonds have a fluorescence under ultraviolet radiation (synthetic or artificial diamonds do not have a fluorescence). As long as diamonds are evaluated by observing the 4C's, the natural diamonds having a fluorescence demand a lower value. Since few diamonds have a strong fluorescence or a very strong fluorescence, even when only natural diamonds are arranged, there coexists a diamond or diamonds having a fluorescence and a diamond or diamonds not having a fluorescence. Any groups of natural diamonds should irregularly include a fluorescent diamond or diamonds and a non-fluorescent diamond or diamonds.

It is accordingly an object in one aspect of the embodiment to provide an ornamental device reliably distinguished from a group of diamonds generally available in the market.

RELATED DOCUMENT

Japanese Patent Publication No. 3280594
PCT International Publication WO 2010/052702

SUMMARY

According to an aspect of the invention, an ornamental device includes: diamonds disposed on a single support element in a specific physical arrangement, all the diamonds in the specific physical arrangement having a blue fluorescent equal to or stronger than strong blue, wherein all the diamonds in the specific physical arrangement shining clear under a visible light, and shining blue under ultraviolet radiation keeping the specific physical arrangement distinguished from a group of diamonds in the specific physical arrangement, the group of diamonds comprising a mixture of a diamond or diamonds having a blue fluorescence equal to or stronger than strong blue and a diamonds or diamonds not having a blue fluorescent equal to or stronger than strong blue.

The ornamental device of the aspect allows the diamonds to shine white and clear under a visible light such as the natural light based on irradiation, dispersion and glance. The diamonds shine blue based on a blue fluorescence under black light or other ultraviolet radiation. Since all the diamonds on a single support element have a blue fluorescence stronger than strong blue, blue radiation of the diamonds under ultraviolet radiation is identical to the specific physical arrangement of the diamonds. Since few natural diamonds have a strong fluorescence or a very strong fluorescence, even when only natural diamonds are arranged, there coexists a diamond or diamonds having a fluorescence and a diamond or diamonds not having a fluorescence. Accordingly, any groups of diamonds without selection should suffer from a black spot or spots existing in the specific physical arrangement under the ultraviolet radiation. The blue radiation of the diamonds cannot usually be identical to the specific physical arrangement. The ornamental device of the aspect can in this manner be distinguished from a group of diamonds generally available in the market. The distinguished blue radiation of the diamonds is expected to contribute to identification of a specific element or the human being. The ornamental device may function as a proof of the membership, for example. In this case, a black light device may be prepared for example to identify the specific element or human being.

Here, the blue radiation of the diamonds is identical to a specific physical arrangement for each of the support elements. An observer recognizes the specific physical arrangement of the diamonds on each of the support elements under the natural light. If all the diamonds have a blue fluorescence equal to or stronger than strong blue for each of the support elements, the observer reliably distinguishes the ornamental device of the aspect from the other groups of diamonds by subjecting the diamonds to black light.

According to another aspect of the invention, an identification device includes: diamonds disposed on a single support element in a specific physical arrangement, all the diamonds in the specific physical arrangement having a blue fluorescent equal to or stronger than strong blue, wherein all the diamonds in the specific physical arrangement shining clear under a visible light, and shining blue under black light keeping the specific physical arrangement distinguished from a group of diamonds in the specific physical arrangement, the group of diamonds comprising a mixture of a diamond or diamonds having a blue fluorescent equal to or stronger than strong blue and a diamonds or diamonds not having a blue fluorescent equal to or stronger than strong blue.

The object and advantages of the embodiment will be realized and attained by means of the elements and combinations particularly pointed out in the appended claims. It is to be understood that both the foregoing general description and the following detailed description are exemplary and explanatory and are not restrictive of the embodiment, as claimed.

DESCRIPTION OF EMBODIMENT

Embodiments of the present invention will be explained below with reference to the accompanying drawings.

Figure 1:
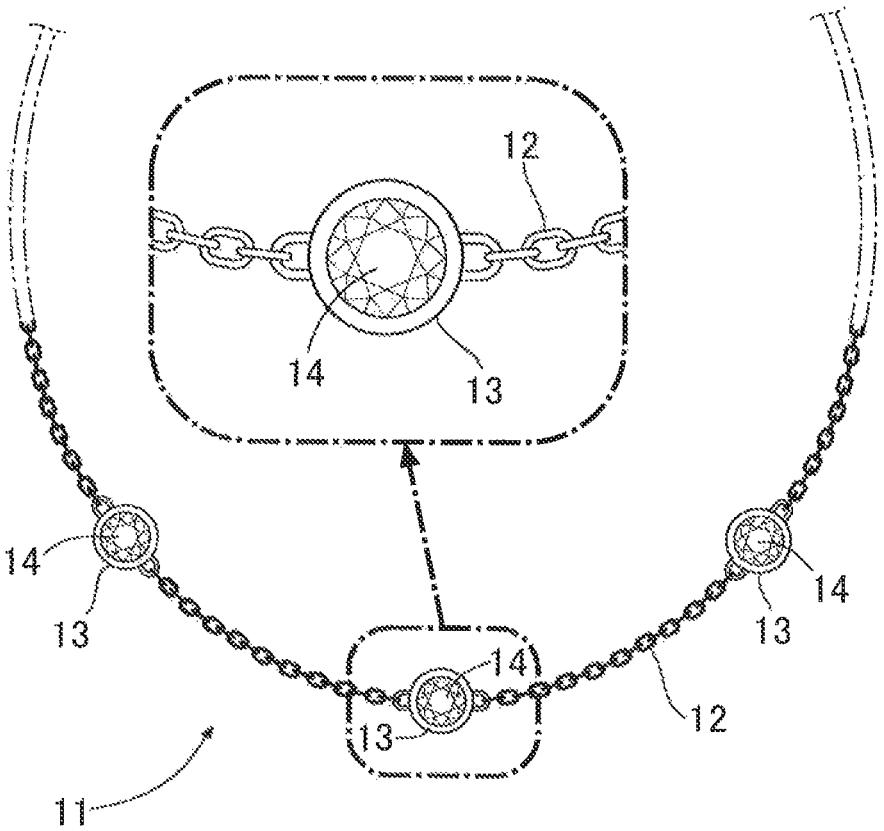
FIG. 1 is a perspective view schematically illustrating a necklace as an ornamental device according to a first embodiment of the invention.
Figure 2:
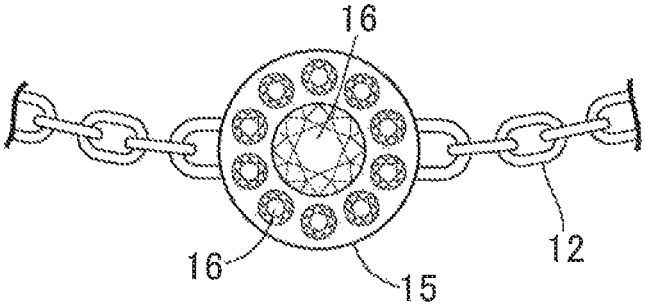
FIG. 2 is a perspective view schematically illustrating a necklace according to a modified example of the first embodiment.

FIG. 1 schematically illustrates a necklace 11 as an ornamental device as a first embodiment of the invention. The necklace 11 comprises a chain 12 made of metal such as platinum, gold, or the like. Settings 13 are set in the chain 12. The settings 13 are made of metallic material such as platinum, gold, or the like, for example. The settings 13 may be integral to the chain 12. A diamond 14 is set on each of the settings 13. The diamonds 14 are arranged in the necklace 11 as an ornamental device. All the diamonds 14 on the necklace 11 have been sorted and preselected to have a blue fluorescence equal to or stronger than strong blue, in other words, have a strong blue fluorescence or a very strong blue fluorescence. The diamonds 14 are in this manner arranged along the chain 12. Otherwise, as depicted in FIG. 2, diamonds 16 may be arranged on a pendant 15 as a single support element. The diamonds 16 may have an equal size or different sizes. The pendant 15 may be detachably attached to the chain 12. The ornamental device may likewise be formed as a bracelet or an anklet.

The diamonds 14, 16 shine white and clear under a visible light such as the natural light based on irradiation, dispersion and glance. The diamonds 14, 16 shine blue, based on a blue fluorescence, under black light or other ultraviolet radiation. Since all the diamonds 14, 16 have a blue fluorescence stronger than strong blue, blue radiation of the diamonds 14, 16 under ultraviolet radiation is identical to the specific physical arrangement of the diamonds 14, 16. Since few natural diamonds have a strong fluorescence or a very strong fluorescence, even when only unsorted natural diamonds are arranged, there coexists a diamond or diamonds having a fluorescence and a diamond or diamonds not having a fluorescence. Accordingly, any unsorted groups of comparable diamonds without such preselection should suffer from a black spot or spots existing in the specific physical arrangement. The blue radiation of the unsorted diamonds cannot usually be identical to the specific physical arrangement. The necklace 11 of the embodiment can in this manner be distinguished from any groups of unsorted diamonds generally available in the market. The distinguished blue radiation of the diamonds 14, 16 is expected to contribute to identification of a specific element or the human being. The necklace 11 may function as a proof of the membership, for example. In this case, a black light device may be prepared for example to identify the specific element or human being. For example, some may propose the arrangement of fluorescent diamonds in the form of alphabet or like character or pattern. However, in that case, an observer cannot recognize the alphabet or pattern under a visible light, and the recognition of the alphabet or pattern is diversified resulting from the individuality of the observers even under the black light, a reliable identification of the specific element or human being cannot be achieved.

The diamonds 16 are fixed on a single support element (the pendant 15). The blue radiation of the diamonds 16 under ultraviolet radiation is identical to the specific physical arrangement of the diamonds 16 for each of the support elements. An observer recognizes the specific physical arrangement of the diamonds 16 on each of the support elements under the natural light. If all the diamonds 16 have a blue fluorescence equal to or stronger than strong blue for each of the support elements, the observer reliably distinguishes the ornamental device of the embodiment from the other groups of diamonds by subjecting the diamonds to a black light.

Figure 3:
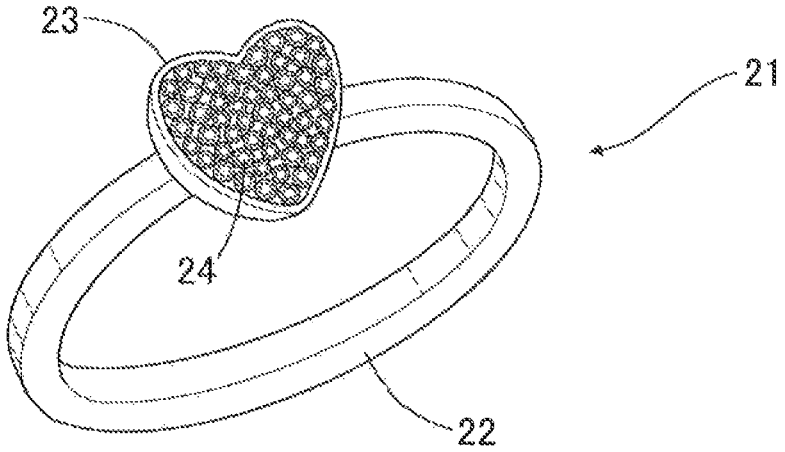
FIG. 3 is a perspective view schematically illustrating a ring as an ornamental device according to a second embodiment of the invention.
Figure 4:
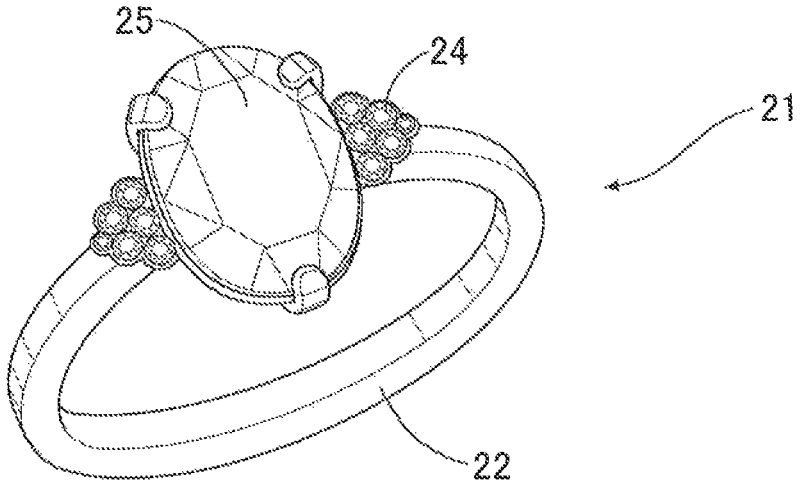
FIG. 4 is a perspective view schematically illustrating a ring according to a modified example of the second embodiment.
Figure 5:
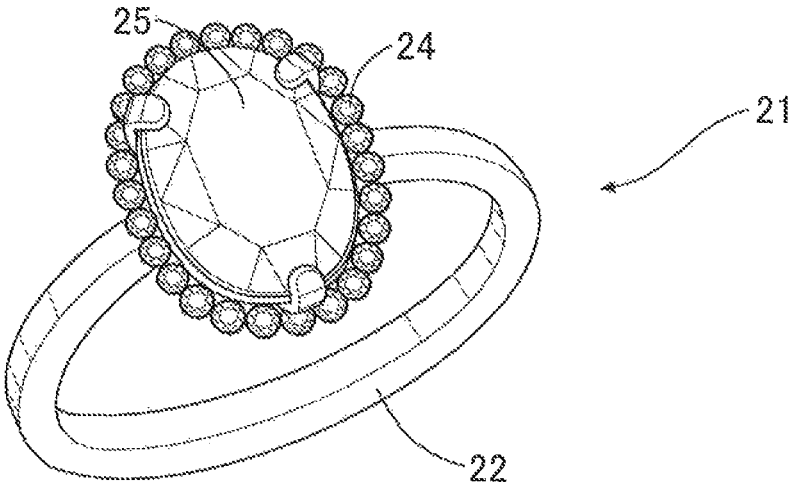
FIG. 5 is a perspective view schematically illustrating a ring according to another modified example of the second embodiment.

FIG. 3 schematically illustrates a ring 21 as an ornamental device according to a second embodiment. The ring 21 comprises an annular element 22 made of metal such as platinum, gold, or the like. A setting 23 is set on the annular element 22. The setting 23 may have the shape of a diagram, or any other design such as a heart shape, a snake, a star. Diamonds 24 are arranged on the setting 23. The diamonds 24 may be adhered to the setting 23. All the diamonds 24 on the setting 23 have a blue fluorescence equal to or stronger than strong blue, in other words, have a strong blue fluorescence or a very strong blue fluorescence. The setting 23 may be incorporated in an ornamental device such as a brooch, a tiara, pierced earrings, clip-on earrings, or the like. Alternatively, as depicted in FIGS. 4 and 5, the diamonds 24 may be used as side stones for a ruby 25 and other gemstone or gemstones.

Figure 6:
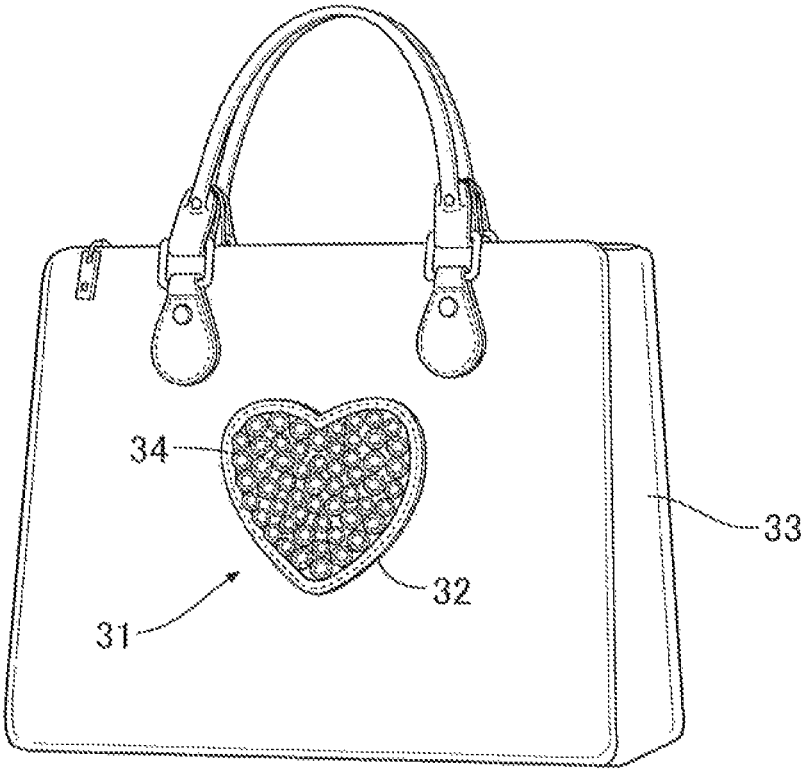
FIG. 6 is a perspective view schematically illustrating an ornamental device according to a third embodiment of the invention.

FIG. 6 schematically illustrates an ornamental device 31 according to a third embodiment of the invention. The ornamental device 31 comprises a setting 32. The setting 32 may be sewed onto (alternatively, attached to) a bag 33, a brassiere, underpants, or the like. Diamonds 34 are arranged on the setting 32. The diamonds 34 may be adhered to the setting 34. All the diamonds 34 on the setting 33 have a blue fluorescence equal to or stronger than strong blue, in other words, have a strong blue fluorescence or a very strong blue fluorescence.

Figure 7:
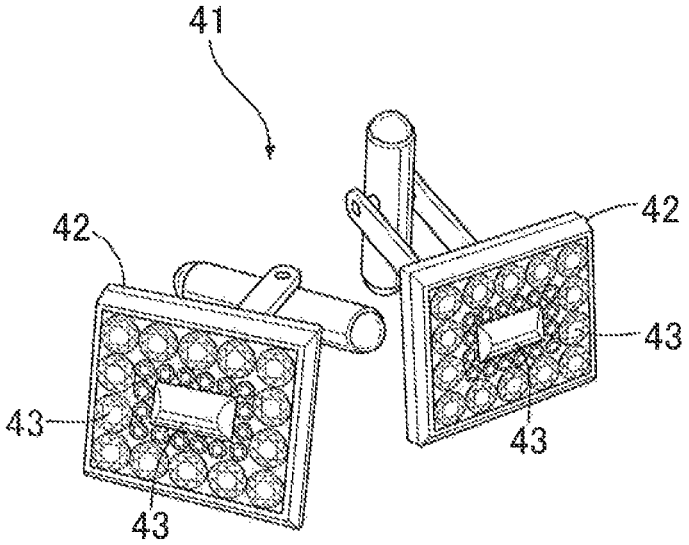
FIG. 7 is a perspective view schematically illustrating cuff buttons as an ornamental device according to a fourth embodiment of the invention.

FIG. 7 schematically illustrates cuff buttons 41 as an ornamental device according to fourth embodiment of the invention. The cuff buttons 41 include insert members 42 made of metal such as platinum, gold, or the like. Diamonds 43 are embedded into the insert member 42. The diamonds 43 are in this manner arranged on cuff buttons 41 as an ornamental device. All the diamonds 43 on each of the insert members 41 have a blue fluorescence equal to or stronger than strong blue, in other words, have a strong blue fluorescence or a very strong blue fluorescence. The diamonds 43 may have an equal size or different sizes. Alternatively, the diamonds 43 may be embedded into a tie pin, a belt, a cigarette lighter, a watch, a pin badge, glasses, a cigarette case, a ballpoint pen, a fountain pen, a smartphone cover, a calculator, a mouse, a frame of a mirror, or the like.

In any of the aforementioned embodiments, all the diamonds 14, 16, 24, 34, 43 preferably have a very strong blue fluorescence. The diamonds 14, 16, 24, 34, 43 of the type allows a constant strong blue radiation over the specific physical arrangement. The tone of the blue radiation is constant over the specific physical arrangement. The ornamental devices of the embodiments are allowed to enjoy a superior ornamental performance.

The present inventor is the first one who makes in the world an ornamental device having diamonds all of which have a strong blue fluorescence or a very strong blue fluorescence. People in the world so far never catch an ornamental device having diamonds all of which have a strong blue fluorescence or a very strong blue fluorescence.

No jewelry shops or makers in the world try to distribute a jewelry having diamonds all of which have a strong blue fluorescence or a very strong blue fluorescence, because diamonds having a strong blue fluorescence or a very strong blue fluorescence suffer from a poor demand under the 4C's evaluation system. Only a low value is given to diamonds all of which have a strong blue fluorescence or a very strong blue fluorescence, diamonds having a fluorescence demand a low price as compared with diamonds not having a fluorescence. Accordingly, if any jewelry shop or maker starts selling the ornamental devices of the embodiments, a great demand inevitably happens for diamonds having a fluorescence, diamonds having a fluorescence are expected to demand a higher price.

All examples and conditional language recited herein are intended for pedagogical purposes to aid the reader in understanding the invention and the concept contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An identification device designed to identify a membership, said identification device comprising: diamonds arranged on a single device in a designed physical arrangement, wherein all the diamonds in the designed physical arrangement have a blue fluorescence equal to or stronger than strong blue, the device having a property distinguished from any other device having a group of diamonds arranged in the designed physical arrangement making a black spot or spots under the radiation of the ultraviolet light;

wherein all diamonds on the device have a very strong blue fluorescence when exposed to ultraviolet light.

2. The ornamental device of claim 1, wherein the diamonds are matched so that a tone of the blue fluorescence is substantially constant over the designed physical arrangement.

3. An ornamental device comprising:

a setting formed from a precious metal and having a predetermined shape;

a plurality of diamonds arranged on, and adhered to the setting in a designed physical arrangement, wherein all of the diamonds in the arrangement have a clear shining property under a natural light, and have a blue shining property under ultraviolet light, wherein a rating of the blue shining property is equal to or stronger than strong blue;

wherein all of the diamonds on the device have a very strong blue fluorescence when exposed to ultraviolet light.

4. The ornamental device of claim 3, wherein the diamonds are matched so that a tone of the blue fluorescence is substantially constant over the designed physical arrangement.

* * * * *